US006435139B1

(12) United States Patent
Brucher

(10) Patent No.: US 6,435,139 B1
(45) Date of Patent: Aug. 20, 2002

(54) WASTE HEAT BOILER FOR COOLING HOT SYNGAS

(75) Inventor: Peter Brucher, Oranienburg (DE)

(73) Assignee: Borsig GmbH, Berlin (DE)

( * ) Notice: Subject to any disclaimer, the term of this patent is extended or adjusted under 35 U.S.C. 154(b) by 0 days.

(21) Appl. No.: 09/992,748

(22) Filed: Nov. 16, 2001

(30) Foreign Application Priority Data

Dec. 14, 2000 (DE) ..... 100 62 320

(51) Int. Cl.[7] ..... F22D 1/00
(52) U.S. Cl. ..... 122/7 R; 122/30; 122/32
(58) Field of Search ..... 122/30, 31.2, 32, 122/7 R

(56) References Cited

U.S. PATENT DOCUMENTS 3,653,363 A * 4/1972 Romanos ..... 122/32
4,462,339 A * 7/1984 Jahnke et al. ..... 122/32
4,488,513 A * 12/1984 Jahnke et al. ..... 122/32
4,721,065 A * 1/1988 Mohrenstecher et al. ..... 122/32

* cited by examiner

*Primary Examiner*—Jiping Lu
(74) *Attorney, Agent, or Firm*—Thomas S. Baker, Jr.

(57) ABSTRACT

A waste heat boiler for cooling hot syngas in heat exchange with water under boiling pressure, consists of an outer pressure shell (1) having a water space (2) filled with boiling water up to a predetermined fluid level (4) and a steam space (3) above it. In the water space (2), heat exchanger tubes (5) are arranged, through which the syngas to be cooled flows. Downstream from the heat exchanger tubes (5) is a superheater for superheating the saturated steam generated by the boiling water. This superheater is positioned at least partially in the steam space (3) above the fluid level (4) and has straight tubes (7), through which the syngas coming from the heat exchanger tubes (5) flows and around which the steam exiting from the water space (2) circulates.

20 Claims, 1 Drawing Sheet

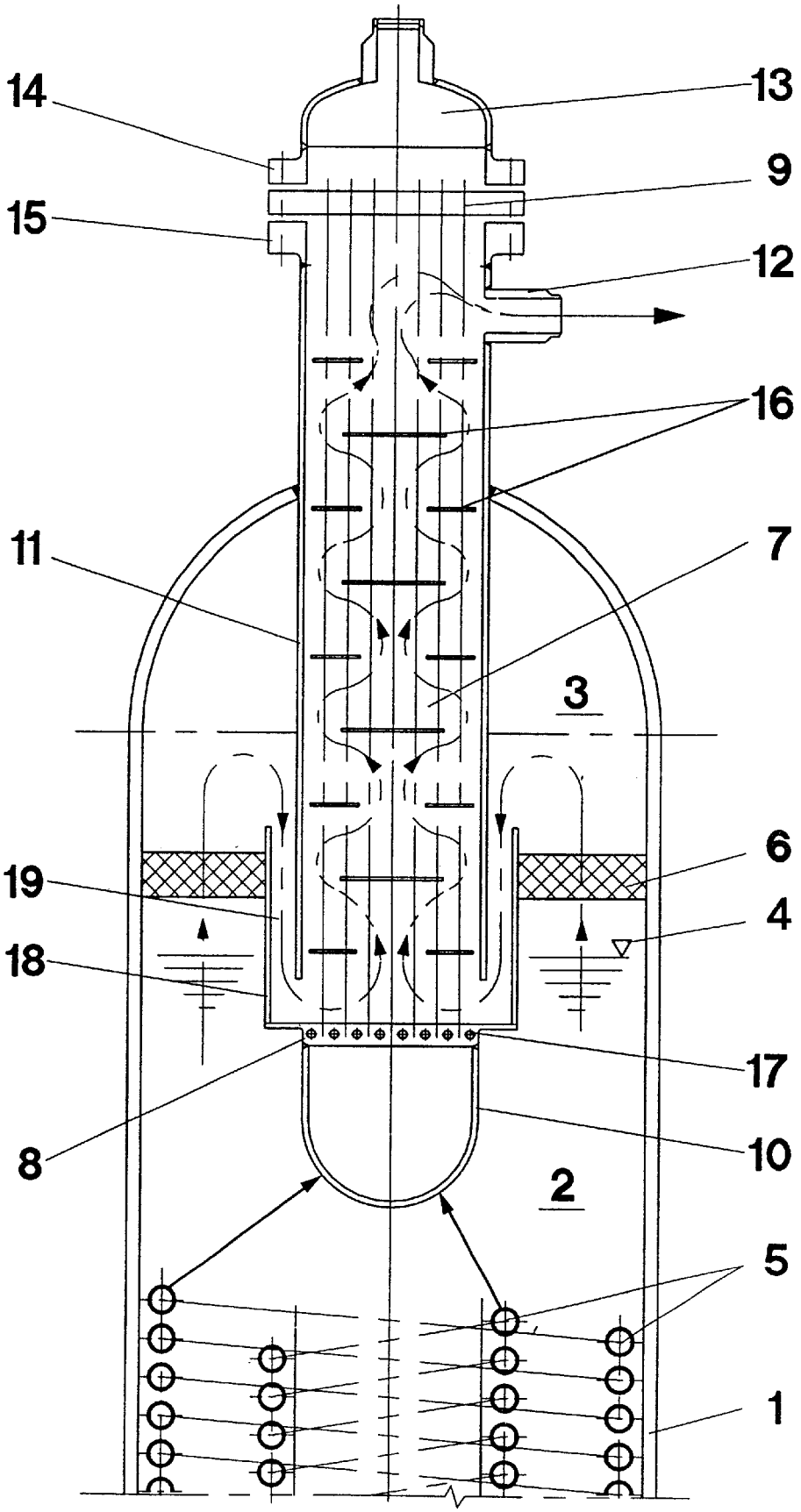
14
13
9
15
12
16
11
7
3
6
19
4
18
17
8
10
2
5
1

WASTE HEAT BOILER FOR COOLING HOT SYNGAS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY REFERENCE OF MATERIAL SUBMITTED ON A COMPACT DISC

Not Applicable.

BACKGROUND OF THE INVENTION

This invention relates to a waste heat boiler for cooling hot synthesis gas (syngas).

Hot syngases such as those generated in oil or residue gasification plants, are cooled in a syngas waste heat boiler downstream from the gasification rector. The thermal energy of the syngas is recovered, producing high-pressure saturated steam. In order to serve a subsequent useful purpose, this saturated steam usually has to be superheated.

Syngas waste heat boilers for generating high-pressure saturated steam may consist of spiral-coiled tubes, for instance, or a bundle of straight or U-shaped tubes that form the heat-exchange surface. The hot syngas flows through these spiral-coiled tubes or tube bundles and releases its heat to the water, which is under boiling pressure and surround-the spiral-coiled tubes or tube bundles inside a pressure shell.

The saturated steam is superheated in a separate superheater downstream from the waste heat boiler. Also known are steam superheaters integrated into syngas waste heat boilers, which superheaters consist of spiral-coiled tubes installed downstream from the waste heat boiler coiled tubes, and in which the syngas flows through the coiled tubes in the same way it does in the waste heat boiler. As a rule, the superheater coiled tubes have a smaller tube diameter than the waste heat boiler coiled tubes. The saturated steam is conducted around the superheater coiled tubes, being superheated in the process. This design has the following serious disadvantages: It is inherently expensive and complex; it can only be inspected and repaired with considerable expenditures. The syngas flowing through the superheater coiled tube can cause deposits to form inside the coiled tube that lead to clogging, making the superheater ineffective. Due to the relatively small tube diameter, these occlusions are almost impossible to remove or only with great difficulty.

Furthermore, coiled-tube steam superheaters, integrated into syngas waste heat boilers, are known (Chem.-Ing.-Techn.56, 1984, Issue 5, pp. 356–360), in which the syngas is conducted around the coiled tubes, and the saturated steam to be superheated, through the coiled tubes. This integrated steam superheater is also expensive and complex and can only be inspected and repaired with considerable effort and expenditures. In addition, at least in the case of gasification of liquid feedstock, the flow channels between the coiled tubes become clogged by sediments from the syngas. These sediments cannot be removed and, after a certain period of time, render the superheater ineffective.

The goal of the invention is to integrate the superheater into the waste heat boiler in such a way as to create a simple and cost-effective design, where the superheater is relatively easy to inspect, to clean and to repair.

DESCRIPTION OF THE DRAWINGS

The drawing is a schematic cross-section of the upper part of a waste heat boiler for cooling syngas.

BRIEF SUMMARY OF THE INVENTION

A waste heat boiler for cooling hot syngas and heat exchange with water under boiling pressure consists of an outer pressure shell having a water space filled with boiling water up to a predetermined level and a steam space above it. Heat exchanger tubes through which the syngas to be cooled flows are arranged in the water space. A superheater for superheating the saturated steam generated by the boiling water, is installed downstream of the heat exchanger tubes and arranged within the pressure shell such that the superheater is positioned at least partially in the steam space above the fluid level. The superheater is provided with straight tubes through which the syngas coming from the heat exchanger tubes flows and around which the steam exiting from the water space circulates.

DETAILED DESCRIPTION OF THE INVENTION

The waste heat boiler for cooling syngas is a heat exchanger of vertical design. It is made up of a pressure shell 1 enclosing a water space 2 and a steam space 3 above it. Water space 2 is filled with water under high boiling pressure up to fluid level 4. At the lower part (not shown) of pressure shell 1, there is a connection piece for admitting the water that is used as the heat exchange medium.

In water space 2, heat exchanger pipes 5 are arranged through which the syngas to be cooled flows. The heat exchanger pipes 5 are designed as single or multipass spiral-shaped coiled tubes.

During the heat exchange with the hot syngas, the water surrounding heat exchanger tubes 5 partially evaporates and enters steam space 3 at fluid level 4 in the form of saturated steam. Above fluid level 4, there is a droplet separator 6 inside steam space 3 for drying the saturated steam.

Downstream from heat exchanger tubes 5, which serve as an evaporator, there is a superheater that cools the syngas further while superheating the dried saturated steam. The superheater lies, at least partially, within pressure shell 1 and is thus integrated into the waste heat boiler. The superheater contains a vertically-aligned bundle of straight tubes 7, arranged next to one another in several rows and tightly inserted into a lower tube sheet 8 and an upper tube sheet 9. Lower tube sheet 8 forms the upper part of a hood-shaped gas inlet chamber 10, which heat exchanger tubes 5 extend.

The bundle of tubes 7 of the superheater is enclosed by a conductive shell 11, which extends almost to lower tube sheet 8, forming a passage between the lower edge of conductive shell 11 and lower tube sheet 8. The superheater projects from pressure shell 1. At the point of exit of the superheater, conductive shell 11 is tightly connected to pressure shell 1. Outside of pressure shell 1, an outlet pipe connection 12 is attached to conductive shell 11.

Above upper tube sheet 9, there is a hood-shaped gas outlet chamber 13. Gas outlet chamber 13 and conductive shell 11 are each equipped with a ring flange 14, 15. Upper tube sheet 9 is clamped between these two ring flanges 14, 15.

Inside conductive shell 11, baffle plates 16, serving as baffles for the medium flowing around tubes 7, are arranged offset against each other and transverse to tubes 7.

The superheater is arranged inside pressure shell I such. that gas inlet chamber 10 together with lower tube sheet 8 is located in water space 2 below fluid level 4. Therefore, gas inlet chamber 10 is well cooled from the water side, preventing overheating of materials.

Between the rows of tubes 7, cross holes 17, which are open at both ends toward water space 2, pass through lower tube sheet 8. Cross holes 17 therefore are filled with water, which cools lower tube sheet 8.

A collar 18 is tightly connected to the outer edge of lower tube sheet 8. This collar 18 surrounds the lower portion of conductive shell 11 and forms annulus 19. The upper edge of collar 18 extends upward into steam space 3, beyond fluid level 4. Between collar 18 and pressure shell 1, droplet separator 6 extends across steam space 3.

The waste heat boiler described here works as follows. The hot syngas to be cooled, such as from a gasification reactor, is fed to the coils of heat exchanger tubes 5, passes through these heat exchanger tubes 5 and enters gas inlet chamber 10. Gas inlet chamber 10 distributes the syngas to tubes 7 of the superheater. After passing through tubes 7 of the superheater, the syngas enters gas outlet chamber 13, from where it is carried off.

Pressure shell 1 of the waste heat boiler is filled with as much water, under high pressure, as necessary to maintain fluid level 4 at a predetermined height. The water present in water space 2 and surrounding heat exchanger tubes 5, partially evaporates during heat exchange with the hot syngas and enters in the form of saturated steam, into steam space 3 at fluid level 4. In passing through droplet separator 6, the wet saturated steam is dried. From there, the dried saturated steam flows downward into annulus 19 between collar 18 and conductive shell 11, and enters the interior space enclosed by conductive shell 11 via the passage between the lower edge of conductive shell 11 and lower tube sheet 8. At this point, the superheating of the saturated steam begins: The dried saturated steam is conducted along tubes 7 of the superheater to outlet pipe connection 12, with frequent deflection by baffle plates 16, thereby absorbing the thermal energy of the syngas flowing through tubes 7. The superheated steam is carried off through outlet pipe connection 12.

Collar 18, which is tightly connected to the outer edge of tube sheet 8, prevents the flooding of the superheater with boiling water.

The fact that the entire lower portion of the superheater, consisting of collar 18, lower tube sheet 8 and gas inlet chamber 10, as well as heat exchanger tubes 5, are submerged in the boiling water in water space 2, makes for a very effective and cooling of these parts that are in contact with the hot syngas.

This type of waste heat boiler with integrated superheater, as described here, is conceptually simple and can be built cost-effectively. The entire superheater tube bundle can be removed from the waste heat boiler in one piece, is easy to inspect, to clean and to repair. It is easy to mechanically rid the interior of the superheater's straight tubes 7 of deposits, during which operation the superheater can remain installed in the syngas waste heat boiler. Only gas outlet chamber 13 must be removed to make superheater tubes 7 accessible from the top.

What is claimed is:

1. Waste heat boiler for cooling hot syngas in heat exchange with water under boiling pressure, consisting of an outer pressure shell (1) having a water space (2) filled with boiling water up to a predetermined level (4) and a steam space (3) above it, of heat exchanger tubes (5), through which the syngas to be cooled flows, arranged in the water space (2), and of a superheater for superheating the saturated steam generated by the boiling water, installed downstream from the heat exchanger tubes (5) and arranged within the pressure shell (1), characterized in that the superheater is positioned at least partially in the steam space (3) above the fluid level (4), and that the superheater is provided with straight tubes (7), through which the syngas coming from the heat exchanger tubes (5) flows and around which the steam exiting from the water space (2) circulates.

2. Waste heat boiler according to claim 1, characterized in that the upper part of the superheater projects from a pressure shell (1) and that a conductive shell (11) surrounds the straight tubes (7) and is tightly connected to the pressure shell (1) at the penetration point of the superheater.

3. Waste heat boiler according to claim 2, characterized in that the straight tubes (7) are tightly inserted into a lower tube sheet (8) and an upper tube sheet (9) and the lower tube sheet (8) is penetrated, between the rows of tubes (7), by cross holes (17) open toward the water space (2).

4. Waste heat boiler according to claim 1, characterized in that the straight tubes (7) are tightly inserted into a lower tube sheet (8) and an upper tube sheet (9) and the lower tube sheet (8) is penetrated, between the rows of tubes (7), by cross holes (17) open toward the water space (2).

5. Waste heat boiler for cooling hot syngas in heat exchange with water under boiling pressure, consisting of an outer pressure shell (1) having a water space (2) filled with boiling water up to a predetermined fluid level (4) and a steam space (3) above it, of heat exchanger tubes (5), through which the syngas to be cooled flows, arranged in the water space (2), and of a superheater for superheating the saturated steam generated by the boiling water, installed downstream from the heat exchanger tubes (5) and arranged within the pressure shell (1), characterized in that the superheater is positioned at least partially in the steam space (3) above the fluid level (4), that the superheater is provided with straight tubes (7), through which the syngas coming from the heat exchanger tubes (5) flows and around which the steam exiting from the water. space (2) circulates, that the tubes (7) of the superheater are tightly inserted into a lower tube sheet (8) and an upper tube sheet (9) and are surrounded by a conductive shell (11), that the lower tube sheet (8) delimits at the top a gas inlet chamber (10), into which the heat exchanger tubes extend, and that the lower tube sheet (8) is located, together with the gas inlet chamber (10), in the water space (2) below the fluid level (4).

6. Waste heat boiler according to claim 5, characterized in that the upper part of the superheater projects from the pressure shell (1) and that the conductive shell (11) is tightly connected to the pressure shell (1) at the penetration point of the superheater.

7. Waste heat boiler according to claim 6, characterized in that the conductive shell (11) extends almost to the lower tube sheet (8), that the lower tube sheet (8) is connected to a collar (18), which surrounds the conductive shell (11) over a partial length of the superheater, forming an annulus (19) at a radial distance, and that the collar (18) extends into the steam space (3).

8. Waste heat boiler according to claim 7, characterized in that a droplet separator (6) extends across the steam space (3) between the collar (18) and the pressure shell (1).

9. Waste heat boiler according to claim 7, characterized in that the lower tube sheet (8) is penetrated, between the rows of tubes (7), by cross holes (17) open toward the water space (2).

10. Waste heat boiler according to claim 6, characterized in that the lower tube sheet (8) is penetrated, between the rows of tubes (7), by cross holes (17) open toward the water space (2).

11. Waste heat boiler according to claim 5, characterized in that the conductive shell (11) extends almost to the lower tube sheet (8), that the lower tube sheet (8) is connected to a collar (18), which surrounds the conductive shell (11) over a partial length of the superheater, forming an annulus (19) at a radial distance, and that the collar (18) extends into the steam space (3).

12. Waste heat boiler according to claim 11, characterized in that a droplet separator (6) extends across the steam space (3) between the collar (18) and the pressure shell (1).

13. Waste heat boiler according to claim 11, characterized in that the lower tube sheet (8) is penetrated, between the rows of tubes (7), by cross holes (17) open toward the water space (2).

14. Waste heat boiler according to claim 5, characterized in that the lower tube sheet (8) is penetrated, between the rows of tubes (7), by cross holes (17) open toward the water space (2).

15. Waste heat boiler for cooling hot syngas in heat exchange with water under boiling pressure, consisting of an outer pressure shell (1) having a water space (2) filled with boiling water up to a predetermined fluid level (4) and a steam space (3) above it, of heat exchanger tubes (5), through which the syngas to be cooled flows, arranged in the water space (2), and of a superheater for superheating the saturated steam generated by the boiling water, installed downstream from the heat exchanger tubes (5) and arranged within the pressure shell (1), characterized in that the superheater is positioned at least partially in the steam space (3) above the fluid level (4), that the superheater is provided with the straight tubes (7), through which the syngas coming from the heat exchanger tubes (5) flows and around which the steam exiting from the water space (2) circulates, that the tubes (7) of the superheater are tightly inserted into a lower tube sheet (8) and an upper tube sheet (9) and are surrounded by a conductive shell (11) and the conductive shell (11) extends almost to the lower tube sheet (8), that the lower tube sheet (8) is connected to a collar (18), which surrounds the conductive shell (11) over a partial length of the superheater, forming an annulus (19) at a radial distance, and that the collar (18) extends into the steam space (3).

16. Waste heat boiler according to claim 15, characterized in that a droplet separator (6) extends across the steam space (3) between the collar (18) and the pressure shell (1).

17. Waste heat boiler according to claim 15, characterized in that the lower tube sheet (8) is penetrated, between the rows of tubes (7), by cross holes (17) open toward the water space (2).

18. Waste heat boiler for cooling hot syngas in heat exchange with water under boiling pressure, consisting of an outer pressure shell (1) having a water space (2) filled with boiling water up to a predetermined fluid level (4) and a steam space (3) above it, of heat exchanger tubes (5), through which the syngas to be cooled flows, arranged in the water space (2), and of a superheater for superheating the saturated steam generated by the boiling water, installed downstream from the heat exchanger tubes (5) and arranged within the pressure shell (1), characterized in that the superheater is positioned at least partially in the steam space (3) above the fluid level (4), that the superheater is provided with straight tubes.(7), through which the syngas coming from the heat exchanger tubes (5) flows and around which the steam exiting from the water space (2) circulates, in that the upper part of the superheater projects from a pressure shell (1) and that a conductive shell (11) surrounds the straight tubes (7) and is tightly connected to the pressure shell (1) at the penetration point of the superheater, that the conductive shell (11) extends almost to the lower tube sheet (8), that the lower tube sheet (8) is connected to a collar (18), which surrounds the conductive shell (11) over a partial length of the superheater, forming an annulus (19) at a radial distance, and that the collar (18) extends into the steam space (3).

19. Waste heat boiler according to claim 18, characterized in that a droplet separator (6) extends across the steam space (3) between the collar (18) and the pressure shell (1).

20. Waste heat boiler according to claim 18, characterized in that the lower tube sheet (8) is penetrated, between the rows of tubes (7), by cross holes (17) open toward the water space (2).

* * * * *